US012029253B2

(12) United States Patent
Goldschmidtboeing et al.

(10) Patent No.: US 12,029,253 B2
(45) Date of Patent: Jul. 9, 2024

(54) METHOD FOR REGULATING THE VAPORISATION OF A VAPORISER IN AN INHALER

(71) Applicant: KÖRBER TECHNOLOGIES GMBH, Hamburg (DE)

(72) Inventors: Frank Goldschmidtboeing, Ortenberg (DE); Uwe Pelz, Schallstadt (DE); Muhannad Ghanam, Freiburg (DE); Peter Woias, Freiburg (DE); Eiko Bäumker, Freiburg (DE); Anjan Bhat Kashekodi, Freiburg (DE); Jan Jaklin, Fellbach (DE)

(73) Assignee: KÖRBER TECHNOLOGIES GMBH, Hamburg (DE)

( * ) Notice: Subject to any disclaimer, the term of this patent is extended or adjusted under 35 U.S.C. 154(b) by 334 days.

(21) Appl. No.: 17/612,456

(22) PCT Filed: May 18, 2020

(86) PCT No.: PCT/EP2020/063856
§ 371 (c)(1),
(2) Date: Nov. 18, 2021

(87) PCT Pub. No.: WO2020/234251
PCT Pub. Date: Nov. 26, 2020

(65) Prior Publication Data

US 2022/0218039 A1 Jul. 14, 2022

(30) Foreign Application Priority Data

May 22, 2019 (DE) ..... 10 2019 113 645.8

(51) Int. Cl.
*A24F 40/53* (2020.01)
*A24F 40/46* (2020.01)
*A24F 40/57* (2020.01)

(52) U.S. Cl.
CPC ..... *A24F 40/53* (2020.01); *A24F 40/46* (2020.01); *A24F 40/57* (2020.01)

(58) Field of Classification Search
None
See application file for complete search history.

(56) References Cited

U.S. PATENT DOCUMENTS 3,944,785 A 3/1976 Eaton-Williams
4,432,211 A 2/1984 Oishi et al.
(Continued)

FOREIGN PATENT DOCUMENTS

CA 2 718 739 A1 10/2009
DE 10 2017 205 625 A1 10/2018
(Continued)

OTHER PUBLICATIONS

Examination report issued by the Japanese Patent Office dated Apr. 15, 2024 in parallel Japanese patent application No. 2021-568988.
(Continued)

*Primary Examiner* — Tho D Ta
(74) *Attorney, Agent, or Firm* — SALIWANCHIK, LLOYD & EISENSCHENK

(57) ABSTRACT

A method of controlling vaporization of a vaporizer in an inhaler, wherein the vaporizer is heated by means of electric resistance heating, and wherein an electronic control device controls the current flow through the vaporizer, comprises the following steps: determining an initial point corresponding to the start of a draw by a consumer; taking measured values of the current applied to the vaporizer in time sequence from the initial point; determining a transition point between a range of low vaporization and a range of high vaporization in a time-dependent current measurement series corresponding to the measured values; determining a current value $I_v$ corresponding to the transition point; setting
(Continued)

a current interval [$I_1$; $I_2$] depending on the determined current value $I_v$; and controlling the current flow within the set current interval [$I_1$; $I_2$].

20 Claims, 3 Drawing Sheets

(56) References Cited

U.S. PATENT DOCUMENTS

| | | | | |
|---|---|---|---|---|
| 2014/0020693 | A1 | 1/2014 | Cochand et al. | |
| 2014/0270727 | A1 | 9/2014 | Ampolini et al. | |
| 2015/0230521 | A1 | 8/2015 | Talon | |
| 2015/0237917 | A1 | 8/2015 | Lord | |
| 2015/0359263 | A1 | 12/2015 | Bellinger | |
| 2016/0206003 | A1 | 7/2016 | Yamada et al. | |
| 2017/0251725 | A1 | 9/2017 | Buchberger et al. | |
| 2018/0020735 | A1 | 1/2018 | Bilat et al. | |
| 2018/0077967 | A1 | 3/2018 | Hatton et al. | |
| 2018/0084608 | A1 | 3/2018 | Bernauer et al. | |
| 2018/0116292 | A1 | 5/2018 | Atkins et al. | |
| 2018/0184712 | A1 * | 7/2018 | Fraser | A24F 40/44 |
| 2019/0037959 | A1 | 2/2019 | Berrian et al. | |
| 2019/0323900 | A1 | 10/2019 | Woelfl | |
| 2020/0037664 | A1 | 2/2020 | Fursa et al. | |
| 2020/0237013 | A1 | 7/2020 | Yamada et al. | |
| 2020/0245687 | A1 | 8/2020 | Tsuji et al. | |
| 2021/0195957 | A1 | 7/2021 | Kessler et al. | |

FOREIGN PATENT DOCUMENTS

| | | | | |
|---|---|---|---|---|
| EP | 2 468 117 | A1 | 6/2012 | |
| JP | H10-118042 | A | 5/1998 | |
| JP | 2006-151285 | A | 6/2006 | |
| JP | 2010-065980 | A | 3/2010 | |
| JP | 2011-515093 | A | 5/2011 | |
| JP | 2014-501105 | A | 1/2014 | |
| JP | 2015-536648 | A | 12/2015 | |
| JP | 2016-517270 | A | 6/2016 | |
| JP | 2017-046700 | A | 3/2017 | |
| JP | 2018-514197 | A | 6/2018 | |
| KR | 2003-0075241 | A | 9/2003 | |
| WO | WO 2013/098397 | A2 | 7/2013 | |
| WO | WO 2018/096000 | A1 | 5/2018 | |
| WO | WO 2018/122410 | A1 | 7/2018 | |
| WO | WO 2018/184810 | A1 | 10/2018 | |
| WO | WO 2018/198152 | A1 | 11/2018 | |
| WO | WO 2019/072960 | A1 | 4/2019 | |
| WO | WO 2019/082262 | A1 | 5/2019 | |
| WO | WO 2019/082282 | A1 | 5/2019 | |
| WO | WO-2019082280 | A1 * | 5/2019 | A24F 40/50 |
| WO | WO-2019082281 | A1 * | 5/2019 | A24F 40/50 |

OTHER PUBLICATIONS

Appeal issued by G.D S.p.A dated Apr. 23, 2024 in parallel European patent application No. 20729963.7.

* cited by examiner

METHOD FOR REGULATING THE VAPORISATION OF A VAPORISER IN AN INHALER

CROSS REFERENCE TO RELATED APPLICATIONS

This application is a National Stage Application of International Application Number PCT/EP2020/063856, filed May 18, 2020; which claims priority to German Patent Application No. 10 2019 113 645.8, filed May 22, 2019.

Field of the Invention

The present invention relates to methods for controlling the vaporization of a vaporizer in an inhaler, wherein the vaporizer is heated by means of electrical resistance heating, and wherein an electronic control device controls the current flow through the vaporizer.

Background of the Invention

Typically, a resistive vaporizer is electrically connected to an energy storage device via an electronic switching element, such that when the switching element is closed, the voltage of the energy storage device is applied to the vaporizer and a heating current flows. The switch is usually operated by the electronic control device.

The temperature at the vaporizer is typically determined using a temperature-dependent electrical resistance of the vaporizer. The relationship between temperature and the electrical resistance of the vaporizer can be used to adjust the temperature of the vaporizer specifically. The temperature should not exceed a temperature determined by the liquid to be vaporized, as otherwise harmful substances may be produced, in particular by the vaporizer falling dry.

The circuit of a vaporizer or heater can be described in simplified terms as a series circuit of electrical resistors. Elements of this series circuit comprise an electrical resistance of the vaporizer (vaporizer resistance), an internal battery resistance, and unwanted parasitic electrical resistances. The parasitic resistances are given, for example, by the following resistances: an electrical resistance belonging to the electrical control device, a current measuring resistor, an electrical resistance of the supply lines, in particular by connecting wires, copper conductive tracks and/or solder joints and, if applicable, an electrical resistance of a possible plug connection. The parasitic resistance is neither constant over time nor reproducible, since plug connections, for example, have an influence on the parasitic resistance depending on the state of aging, contamination and/or deformation which can only be measured with considerable effort.

Temperature measurement errors due to parasitic resistance can lead to overheating of the liquid to be vaporized, which can result in bubble boiling or the formation of pollutants. Because of the multiple errors due to measurement and parasitic currents, the vaporizer can be inadequately controlled by known methods.

It is the task of the invention to provide a method with which the vaporization can be effectively and reliably controlled and overheating of the liquid to be vaporized can be reliably avoided.

BRIEF SUMMARY OF THE INVENTION

According to the invention, the method comprises the following steps: Taking measured values of the current applied to the vaporizer in time sequence starting from an initial point. From the initial point, a current flows through the vaporizer. Due to the current flow and the temperature-dependent electrical resistance of the vaporizer, the vaporizer heats up. Due to the heating of the vaporizer, the temperature-dependent electrical resistance of the vaporizer changes.

Advantageously, the measurement can be switched on by a demand request from a user of the inhaler, in particular by a draw on an electronic cigarette. Accordingly, the measurement may be switched off after the request is completed.

Subsequently, a transition point between a range of low vaporization and in particular to no vaporization and a range of high vaporization in particular during consumption is determined in a time-dependent current measurement series corresponding to the measured values. The transition point marks the point in time at which vaporization occurs and the vaporizer is not heated significantly further. The invention has recognized that from the transition point onward, vaporization occurs to such a high degree that little or no further heating of the vaporizer occurs. The energy provided by the current flow at the vaporizer is converted to energy for vaporization of the liquid and not, or only to a small extent, to heating of the vaporizer. Therefore, from the transition point, the temperature of the vaporizer changes to a lesser extent than at the time before the transition point. Thus, the transition point in the current measurement series can be understood as a kink in the dependence between current and measurement point or time. From the transition point, a current value $I_v$ corresponding to the transition point is determined at which reliable vaporization takes place. To control the heating power via the current flow, a current interval $[I_1; I_2]$ is defined as a function of the determined current value $I_v$ and the current flow is controlled within the defined current interval $[I_1; I_2]$. Thus, the power of the vaporizer can be precisely controlled.

The method according to the invention has the advantage that the vaporizer temperature does not need to be known and the value of the parasitic electrical resistance in particular does not need to be determined in real time and for each individual vaporizer. With the method according to the invention, it is decisive at which respective current or heating power the vaporization occurs through the respective vaporizer. The onset of vaporization is determined on the basis of the measurement series and thus determines the heating current to be applied within the current interval $[I_1; I_2]$.

Advantageously, the transition point is determined by means of a regression along the current measurement series in order to be able to determine the transition point reliably and effectively. A regression is based on a plurality of measured values, which minimizes measurement errors and/or statistical errors. The regression is advantageous compared to, for example, a finite difference method, in which only in particular two adjacent measured values are considered and thus a measurement inaccuracy has a particularly strong effect on the result.

Preferably, the transition point of at least one line of best fit and/or at least one best fit polynomial to the current measurement series is determined in order to provide a numerically effective determination of the transition point. For example, one or more lines of best fit and/or, in particular, quadratic curves of best fit at different measurement points of the measurement series can be determined by the regression. The transition point can be determined from the rises over time belonging to the lines of best fit or the curvatures belonging to the curves of best fit. The curvature can be determined in particular from a coefficient of a quadratic term of the best fit polynomial.

Preferably, the transition point is determined by a step change and/or the reaching of a threshold of the rise or slope (1st derivative) of the current measurement series in order to further improve the identification of the transition point. In an advantageous embodiment, the transition point is determined for this purpose by an extreme value of the curvature of the current measurement series.

Preferably, two successive measured values are temporally separated from each other by less than 10 ms, preferably less than 5 ms, further preferably less than 2 ms, in order to be able to resolve the transition point well in time and to be able to record an advantageous number of measured values over the duration of a draw. For this purpose, the recorded measured values are preferably recorded over at least 10%, advantageously at least 30%, further advantageously at least 50% of a draw duration.

Advantageously, the length of the current interval $[I_1; I_2]$ is less than 50%, advantageously less than 25%, further advantageously less than 10% of the amount of the current value $I_v$, so that the heating current can be controlled as precisely as possible.

In a preferred embodiment, the lower threshold $I_1$ and/or the upper threshold $I_2$ are set such that the lower threshold is smaller than the current value $I_V$ and/or the current value $I_V$ is smaller than the upper threshold $I_2$, so that the heating current can be reliably controlled around the current value $I_V$ in the current interval $[I_1; I_2]$. If the lower threshold $I_1$ is smaller than the current value $I_V$, dry-out of the vaporizer can be prevented because the vaporizer does not vaporize with a current between the lower threshold $I_1$ and the current value $I_V$, but heats the vaporizer and/or the liquid.

Preferably, the current flow through the vaporizer is pulsed, wherein the duty cycle is increased when the lower threshold $I_1$ is reached from above and/or reduced when the upper threshold $I_2$ is reached from below. Thus, a reduction of the input power and an extension of the runtime of a battery supplying the vaporizer with electric current can be achieved.

Advantageously, the lower threshold $I_1$ and/or the upper threshold $I_2$ is determined as a function of an analysis of the average squared current I^2 over a defined time interval. If the average squared current I^2 falls below a predetermined threshold, which can be determined, for example, from the current measurement series from a time interval after the initial point, this is to be taken as an indication of reduced contact between the vaporizer and the liquid. In this case, the lower threshold $I_1$ and/or the upper threshold $I_2$ should be shifted to lower currents.

Preferably, the current interval $[I_1; I_2]$ and/or at least one of the thresholds $I_1$; $I_2$ is shifted to lower currents over time to prevent the vaporizer from running dry. The current interval $[I_1; I_2]$ and/or at least one of the thresholds $I_1$; $I_2$ may also be adjusted to a predetermined time function to effectively control vaporization and allow for adaptation to differential distillation operations.

In an advantageous embodiment, data relating to several time-dependent current measurement series are stored in a data memory and compared with each other and/or with fixed parameters. This makes it possible to store the current measurement values and transition points accumulated during the process. An automatic analysis can, for example, analyze at which point in time the vaporization current $I_V$ was reached. If this point in time is reached later than a predefined threshold, this is an indication that the electrical resistance is too high. Furthermore, the average current square during the vaporization process can be evaluated. If this is lower than a predetermined threshold, the depletion of the liquid can be inferred.

Preferably, the ambient temperature is measured, and the current interval $[I_1; I_2]$ and/or at least one of its thresholds $I_1$, $I_2$ is set and/or adjusted as a function of the measured ambient temperature in order to be able to take into account possible influences of the ambient temperature.

Advantageously, the control of the current flow is done by switching on and/or maintaining the current flow through the vaporizer at a current less than an upper threshold $I_2$, or switching off the current flow through the vaporizer at a current more than a lower threshold $I_1$, in order to be able to provide an effective control method within the current interval $[I_1; I_2]$.

BRIEF DESCRIPTION OF THE FIGURES

The invention is explained below by means of preferred embodiments with reference to the accompanying figures. Thereby shows FIG. 1 a schematic illustration of an inhaler.

DETAILED DESCRIPTION

Figure 1:
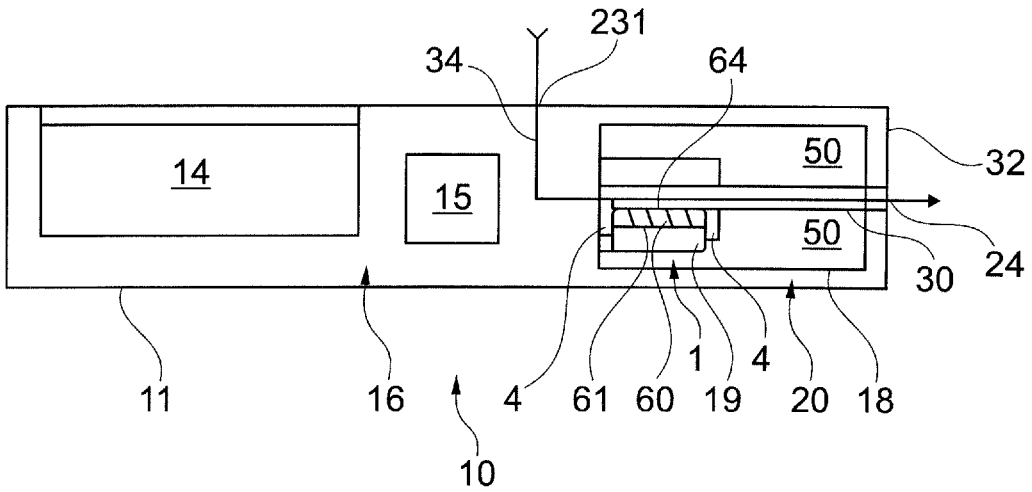

FIG. 1 schematically shows an inhaler 10 or an electronic cigarette product. The inhaler 10 comprises a housing 11 in which an air channel 30 or vent is provided between at least one air inlet opening 231 and an air outlet opening 24 at a mouth end 32 of the cigarette product 10. The mouth end 32 of the inhaler 10 thereby denotes the end at which the consumer draws for the purpose of inhalation, thereby applying a negative pressure to the inhaler 10 and generating an air flow 34 in the air channel 30.

Advantageously, the inhaler 10 comprises a base part 16 and a vaporizer tank unit 20 comprising a vaporizer device 1 having a vaporizer 60 controllable by the method of the invention and a liquid reservoir 18. The vaporizer tank unit may in particular be in the form of a replaceable cartridge. The liquid reservoir 18 may be refillable by the user of the inhaler 10. Air drawn through the air inlet opening 231 is directed in the air channel 30 to the at least one vaporizer 60. The vaporizer 60 is connected or connectable to the liquid reservoir 18, in which at least one liquid 50 is stored. For this purpose, a porous and/or capillary liquid-conducting element 19 is advantageously arranged at an inlet side 61 of the vaporizer 60.

An advantageous volume of the liquid reservoir 18 is in the range between 0.1 ml and 5 ml, preferably between 0.5 ml and 3 ml, further preferably between 0.7 ml and 2 ml or 1.5 ml.

The vaporizer 60 vaporizes liquid 50 supplied to the vaporizer 60 from the liquid reservoir 18 by the porous element 19 by means of capillary forces and/or stored in the porous element 19, and adds the vaporized liquid as an aerosol/vapor to the air stream 34 at an outlet side 64.

The inhaler 10 further comprises an electrical energy storage device 14 and an electronic control device 15. The energy storage device 14 is generally arranged in the base part 16 and may in particular be a disposable electrochemical battery or a rechargeable electrochemical battery, for example a lithium-ion battery. The vaporizer tank unit 20 is disposed between the energy storage device 14 and the mouth end 32. The electronic control device 15 comprises at least one digital data processing device, in particular microprocessor and/or microcontroller, in the base part 16 (as shown in FIG. 1) and/or in the vaporizer tank unit 20.

Advantageously, a sensor, for example a pressure sensor or a pressure or flow switch, is arranged in the housing 11, wherein the control device 15 can determine, based on a sensor signal output by the sensor, that a consumer is drawing on the mouth end 32 of the cigarette product 10 to inhale. In this case, the control device 15 controls the vaporizer 60 to add liquid 50 from the liquid reservoir 18 as an aerosol/vapor into the air stream 34.

The at least one vaporizer 60 is arranged in a part of the vaporizer tank unit 20 facing away from the mouth end 32. This allows for effective electrical coupling, particularly with the base part 16, and control of the vaporizer 60. Advantageously, the air stream 34 passes through an air channel 30 extending axially through the liquid reservoir 18 to the air outlet opening 24.

The liquid 50 stored in the liquid reservoir 18 to be dispensed is, for example, a mixture of 1,2-propylene glycol, glycerol, water, and preferably at least one aroma (flavor) and/or at least one active ingredient, in particular nicotine. However, the indicated components of the liquid 50 are not mandatory. In particular, aroma and/or active ingredients, in particular nicotine, may be omitted.

Figure 2:
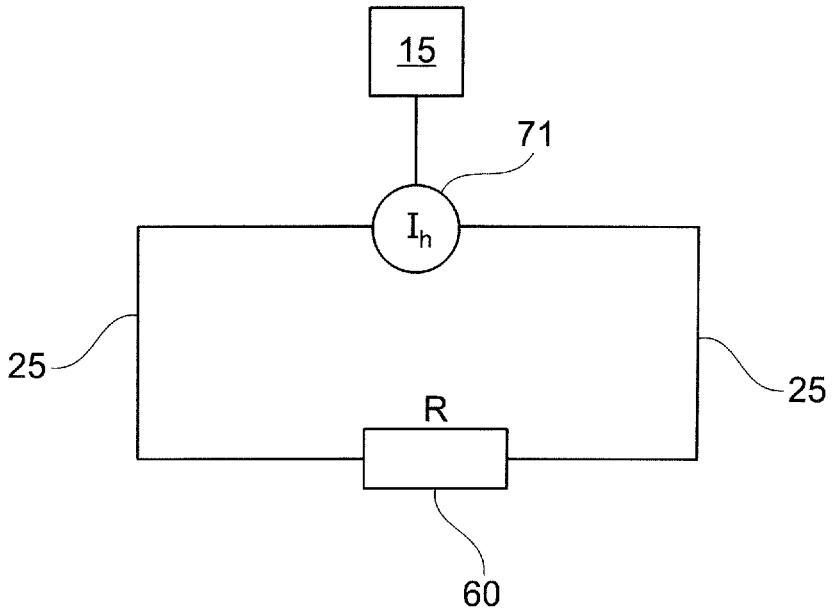
FIG. 2 a simplified circuit for current heating of a vaporizer.

FIG. 2 shows a schematic circuit for current heating of the vaporizer 60. The vaporizer 60 is an electric vaporizer that can be heated by an electric current due to its electrical resistance. The vaporizer 60 may comprise at least one resistive element, such as a heating wire, for example, a spiral wire or one or a plurality of wire conductors arranged in parallel with each other. The vaporizer 60 may alternatively be designed as a micro-electromechanical system (MEMS), for example with conducting or microchannels, as described in DE 10 2016 120 803 A1, the disclosure content of which is to that extent incorporated in the present application. Bionic or capillary heating structures, such as bionic meshes, are also possible for the vaporizer 60. Vaporizers 60 with heating structures as described in DE 10 2017 111 119 A1 are also possible, the disclosure content of which is to that extent incorporated in the present application. In general, the invention is not bound to a specific type of vaporizer 60.

The vaporizer tank unit 20 is preferably connected and/or connectable to a heating current source 71 controllable by the control device 15, which is connected to the vaporizer 60 via electrical lines 25, so that an electric heating current Ih generated by the heating current source 71 flows through the vaporizer 60. Due to the ohmic resistance of the electrically conductive vaporizer 60, the current flow causes heating of the vaporizer 60 and therefore vaporization of liquid in contact with the vaporizer 60. Vapor/aerosol generated in this manner escapes from the vaporizer 60 and is mixed into the air stream 34. More precisely, upon detecting an air flow 34 through the air channel 30 caused by drawing of the consumer, the control device 15 controls the heating current source 71, wherein the liquid in contact with the vaporizer 60 is discharged in the form of vapor/aerosol by spontaneous heating.

The vaporization temperature is preferably in the range between 100° C. and 400° C., more preferably between 150° C. and 350° C., even more preferably between 190° C. and 290° C.

The vaporizer tank unit 20 is set to dispense an amount of liquid preferably in the range between 1 μl and 20 μl, further preferably between 2 μl and 10 μl, still further preferably between 3 μl and 5 μl, typically 4 μl per puff of the consumer. Preferably, the vaporizer tank unit may be adjustable with respect to the amount of liquid/vapor per puff, i.e., per puff duration from 1 s to 3 s.

Advantageously, the drive frequency of the vaporizer 60 generated by the heating current source 71 is generally in the range of 1 Hz to 50 kHz, preferably in the range of 30 Hz to 30 kHz, even more advantageously in the range of 100 Hz to 25 kHz.

Advantageously, the vaporizer 60 may be replaceable in the event of contamination, defect or depleted substrate, such that a separable electrical connection may be provided between the vaporizer 60 the base part 16. This connection can be designed as a spring pin, plug-in or screw connection, for example.

Figure 3:
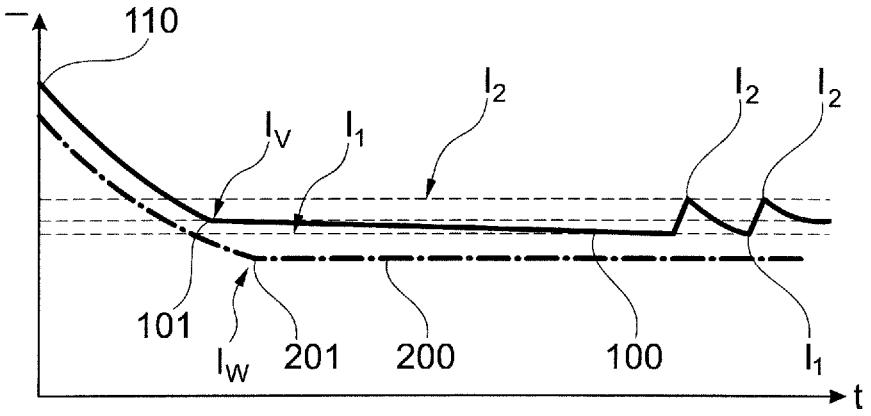
FIG. 3 a schematic current measurement series with a determined transition point.

FIG. 3 shows a schematic current measurement series 100 indicated by a bold black curve with a determined transition point 101 at a current $I_v$, wherein this illustration shows an example of a current measurement series 100 for a vaporizer 60 with a negative temperature coefficient. In FIG. 3, current I is plotted against time t and shown as continuous for illustrative purposes only.

At the beginning of a draw at an initial point 110, determined for example by detecting the draw by means of a pressure sensor or determined by a consumer switching on, the vaporizer 60 is switched on and heated with a heating current. This is followed by a sequential recording in time of measured values 108 (schematically drawn as a curve in FIG. 3) of the current I applied to the vaporizer 60 starting from the initial point 110. The vaporizer 60 heats up relatively quickly, therefore the measured current I drops.

The temporal current measurement series 100 comprises a transition point 101 recognizable as a kink, or at least a strong flattening, which is determined to be the transition point 101 as soon as vaporization starts. This is followed by a two-point control as a function of a current $I_V$ associated with the transition point 101 with the lower threshold and the upper threshold $I_2$, wherein the current I is controlled in the current interval $[I_1; I_2]$: as soon as the determined current flow I exceeds the upper threshold $I_2$, the current source is switched off or the current flow is reduced; as soon as the determined current flow I falls below the lower threshold $I_2$, the current source is switched on or the current flow is increased. The difference between the upper threshold $I_2$ and the current $I_V$ at the transition point 102 and the difference between the current $I_V$ at the transition point 102 and the lower threshold $I_1$ is advantageously smaller than the current $I_V$ at the transition point 102, since no or only a small overtemperature should occur at the vaporizer 60 and thus only a small change in current occurs.

The advantage of the control method described above is illustrated by the lower current measurement series 200 in FIG. 3. The lower current measurement series 200 shows a current curve for a vaporizer 60 which differs in one or more points from the vaporizer 60 of the bold printed current measurement series 100: the battery voltage is a different one, in particular due to the discharge state or internal resistance; the heating resistance of the vaporizer 60 is a different one, in particular due to manufacturing tolerances; other electrical resistances are present.

Thus, for the lower current measurement series 200, there is a transition point 201 at a different current $I_w$, but again at the onset of vaporization. In this example, a lower threshold $I_1$ and an upper threshold $I_2$ can easily be selected within which the current I is controlled so that the vaporizer 60 reliably and effectively vaporizes liquid.

The method according to the invention results in a temperature error that is an order of magnitude smaller than in the case of resistive temperature determination according to the prior art. It is advantageous if the absolute value of the current interval $|I_2-I_1|$ is less than 50%, advantageously less than 25%, further advantageously less than 10% of the absolute value of the current value $I_v$. The process does not control to a fixed temperature, but to a current corresponding to the vaporization temperature or to a temperature slightly above the vaporization temperature. Since the vaporization temperature depends on the composition of the substrate or, in particular, of the liquid, the temperature is not absolute, but the current $I_V$ leading to vaporization is determined.

Figure 4:
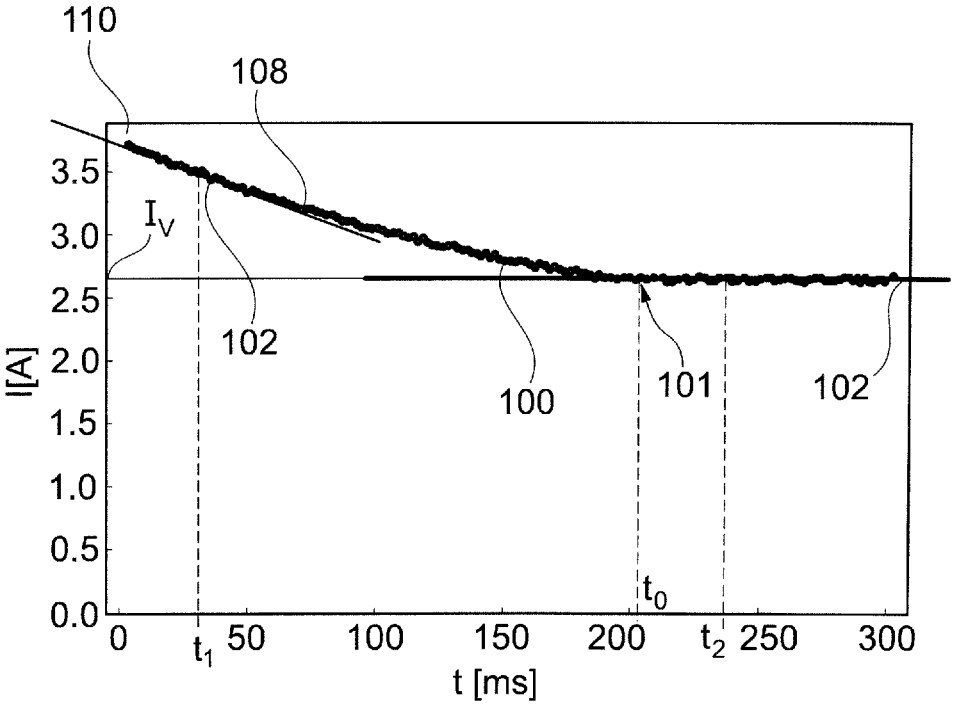
FIG. 4 an exemplary current measurement series with a transition point.

FIG. 4 shows an exemplary current measurement series 100 of a possible measurement curve with a transition point 101 at a time of about t=201 ms and a realistic noise of the current signal. The current measurement series 100 comprises a plurality of successively recorded measurement values 108 in time, represented by a corresponding number of points, wherein each point represents a measurement value 108 with an associated current I at a time t.

Once n values are recorded, the control device 15 calculates a line of best fit 102 from the measured values 108, for example by linear regression. In this example, two different lines of best fit 102 are shown at times $t_1$ and $t_2$. The time course of the rise 109 of the line of best fit 102 determined in this way is shown in FIG. 5.

The regression has the advantage that the transition point 101 can be easily localized even if the current measurement series 100 is overlaid with noise. The regression thus smoothes the rise 109 and offers an improvement over finite differences.

Figure 5:
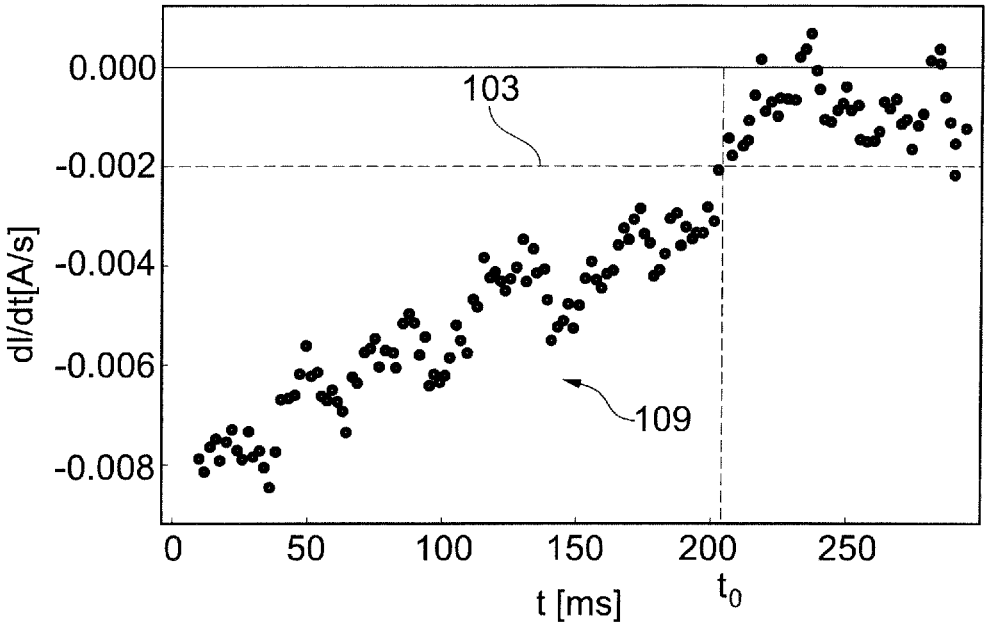
FIG. 5 the determination of a transition point on the basis of the rise of a current measurement series.

FIG. 5 shows a determination of a transition point 101 based on the rise 109 of the current measurement series 100 shown in FIG. 4. The transition point 101 can be detected by evaluating the first or second time derivative of the current I in real time.

The rise 109 is the rise of the line of best fit 102 determined by regression on the current measurement series 100 and is plotted in vs. time t. For example, if the magnitude of the rise 109 falls below a threshold 103, it can be concluded that vaporization has begun. In this example, the transition point 101 is located where the magnitude of the slope 109 of the line of best fit 102 is less than a threshold 103 of, in this example, 0.002 A/s. The threshold 103 can be determined empirically for the vaporizer 60. From the time $t_0$ at which the rise 109 exceeds the threshold 103, the vaporization current $I_V$ can be determined on the basis of the current measurement series 100, in this example approx. 2.6 A (compare FIG. 4).

Figure 6:
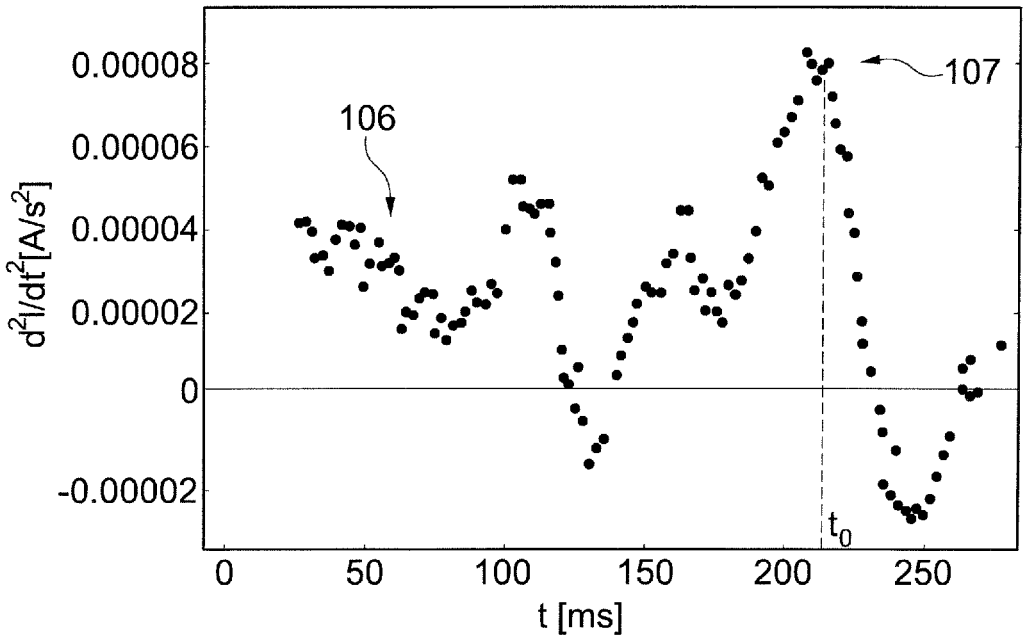
FIG. 6 the determination of a transition point on the basis of the curvature of a current measurement series.

FIG. 6 shows a determination of a transition point 101 on the basis of the curvature 106 of the current measurement series 100 shown in FIG. 4. An extreme value 107 in the second derivative, in particular a maximum, indicates the transition point 101. The transition point 101 or the vaporization point of the current measurement series 101 can also be found via the curvature 106 of the current measurement series 100. For this purpose, instead of a line of best fit 102, a polynomial, in particular of second order, is locally fitted along the current measurement series 100 to a plurality of successive measured values 108 of the current measurement series 100. The coefficient of the quadratic term of the polynomial is determined as curvature 106 and plotted against time t. An algorithm for finding an extreme value 107 finds the extreme value 107 at a time $t_0$ corresponding to the time at which the current measurement series 100 comprises the transition point 101.

EMBODIMENTS

Embodiment 1. Method for controlling the vaporization of a vaporizer (60) in an inhaler (10), wherein the vaporizer (60) is heated by means of electrical resistance heating, and wherein an electronic control device (15) controls the current flow through the vaporizer (60), characterized by the following steps:

taking measured values (108) of the current applied to the vaporizer (60) in time sequence starting from an initial point (110);

determining a transition point (101) between a range of low vaporization and a range of high vaporization in a time-dependent current measurement series (100) corresponding to the measured values (108);

determining, preferably in real time, a current value $I_v$ corresponding to the transition point (101);

setting a current interval $[I_1; I_2]$ as a function of the determined current value $I_v$; and controlling the current flow within the set current interval $[I_v; I_2]$.

Embodiment 2. Method according to claim 1, characterized in that the transition point (101) is determined by means of a regression to the current measurement series (100).

Embodiment 3. Method according to claim 2, characterized in that the transition point (101) is determined on the basis of at least one line of best fit and/or at least one best fit polynomial to the current measurement series (100).

Embodiment 4. Method according to any one of the preceding claims, characterized in that the transition point (101) is determined by a step change and/or the reaching of a threshold (103) of the rise (109) of the current measurement series (100).

Embodiment 5. Method according to any one of the preceding claims, characterized in that the transition point (101) is determined by an extreme value (107) of the curvature (106) of the current measurement series (100).

Embodiment 6. Method according to any one of the preceding claims, characterized in that two successive measured values (108) are temporally separated from one another by less than 10 ms, preferably less than 5 ms, more preferably less than 2 ms.

Embodiment 7. Method according to any one of the preceding claims, characterized in that the recorded measured values (108) are recorded over at least 10%, advantageously at least 30%, further advantageously at least 50% of a draw duration.

Embodiment 8. Method according to any one of the preceding claims, characterized in that the absolute value of the current interval $|I_2-I_1|$ is less than 50%, advantageously less than 25%, further advantageously less than 10% of the absolute value of the current value Iv.

Embodiment 9. Method according to any one of the preceding claims, characterized in that the lower threshold $I_1$ and/or the upper threshold $I_2$ are set such that the lower threshold is smaller than the current value $I_V$ and/or the current value $I_V$ is smaller than the upper threshold $I_2$.

Embodiment 10. Method according to any one of the preceding claims, characterized in that the current flow through the vaporizer (60) is pulsed, wherein the duty cycle is increased when the lower threshold $I_1$ is reached from above and/or reduced when the upper threshold $I_2$ is reached from below.

Embodiment 11. Method according to any one of the preceding claims, characterized in that the lower threshold $I_1$ and/or the upper threshold $I_2$ is determined as a function of an analysis of the average squared current I^2 over a defined time interval.

Embodiment 12. Method according to any one of the preceding claims, characterized in that the current interval $[I_1; I_2]$ and/or its thresholds $I_1$ and/or $I_2$ are shifted to lower currents over time.

Embodiment 13. Method according to any one of the preceding claims, characterized in that data relating several time-dependent current measurement series (100) are stored in a data memory and compared with one another and/or with fixed parameters.

Embodiment 14. Method according to any one of the preceding claims, characterized in that the ambient temperature is measured and the current interval $[I_1; I_2]$ and/or at least one of its thresholds $I_1$, $I_2$ is fixed and/or adjusted as a function of the measured ambient temperature.

Embodiment 15. Method according to any one of the preceding claims, characterized in that the current flow is controlled by switching on and/or maintaining the current flow through the vaporizer (60) at a current less than an upper threshold $I_2$, or switching off the current flow through the vaporizer (60) at a current more than a lower threshold $I_1$.

LIST OF REFERENCE SIGNS

1 vaporizer device
4 carrier
10 inhaler
11 housing
14 energy storage device
15 control device
16 basis part
18 liquid reservoir
19 wick structure
20 vaporizer tank unit
24 air outlet opening
30 air channel
32 mouth end
34 air stream
50 liquid
60 vaporizer
61 inlet side
62 liquid channel
64 outlet side
71 heating current source
100, 200 current measurement series
101, 201 transition point
102 line of best fit
103 threshold
104 passage opening
105*a*, 105*b* electrical line
106 curvature
107 extreme value
108 measured value
109 rise
110 initial point
131 contact area
231 air inlet opening
$I$, $I_v$, $I_w$ current value
$I_1$ lower threshold
$I_2$ upper threshold
$t_0$, $t_1$, $t_2$ time

The invention claimed is:

1. A method for controlling the vaporization of a vaporizer in an inhaler, comprising:

providing a vaporizer heated via electrical resistance heating;

providing an electronic control device that controls a current flow through the vaporizer;

taking measured values of a current applied to the vaporizer in time sequence starting from an initial point;

determining a transition point between a range of low vaporization and a range of high vaporization in a time-dependent current measurement series corresponding to the measured values;

determining a current value $I_v$ corresponding to the transition point;

setting a current interval $[I_1; I_2]$ as a function of the determined current value $I_v$, where $I_1$ is a lower threshold and $I_2$ is an upper threshold; and controlling the current flow through the vaporizer within the set current interval $[I_1; I_2]$.

2. The method according to claim 1, wherein the transition point is determined via a regression to the time-dependent current measurement series.

3. The method according to claim 2, wherein the transition point is determined on the basis of at least one line of best fit and/or at least one best fit polynomial to the time-dependent current measurement series.

4. The method according to claim 1, wherein the transition point is determined by a step change and/or the reaching of a threshold of the rise of the time-dependent current measurement series.

5. The method according to claim 1, wherein the transition point is determined by an extreme value of the curvature of the current time-dependent measurement series.

6. The method according to claim 1, wherein two successive measured values are temporally separated from one another by less than 10 ms.

7. The method according to claim 1, wherein the recorded measured values are recorded over at least 10% of a draw duration.

8. The method according to claim 1, wherein an absolute value of the current interval $|I_2-I_1|$ is less than 50% of an absolute value of the current value $I_v$.

9. The method according to claim 1, wherein the lower threshold $I_1$ and/or the upper threshold $I_2$ are set such that the lower threshold $I_1$ is smaller than the current value $I_v$ and/or the current value $I_v$ is smaller than the upper threshold $I_2$.

10. The method according to claim 1, wherein the current flow through the vaporizer is pulsed, wherein a duty cycle of the current flow through the vaporizer is increased when the lower threshold $I_1$ is reached from above and/or reduced when the upper threshold $I_2$ is reached from below.

11. The method according to claim 1, wherein the lower threshold $I_1$ and/or the upper threshold $I_2$ is determined as a function of an analysis of the average squared current I^2 over a defined time interval.

12. The method according to claim 1, wherein the current interval $[I_1; I_2]$ and/or the lower threshold $I_1$ and/or the upper threshold $I_2$ are shifted to lower currents over time.

13. The method according to claim 1, wherein data relating several time-dependent current measurement series are stored in a data memory and compared with one another and/or with fixed parameters.

14. The method according to claim 1, wherein an ambient temperature is measured and the current interval $[I_1; I_2]$ and/or at least one of the lower threshold $I_1$ and upper threshold $I_2$ is fixed and/or adjusted as a function of the measured ambient temperature.

15. The method according to claim 1, wherein the current flow through the vaporizer is controlled by switching on and/or maintaining the current flow through the vaporizer at a current less than the upper threshold $I_2$, or switching off the current flow through the vaporizer at a current more than the lower threshold $I_1$.

16. The method according to claim 1, wherein determining the current value $I_v$ corresponding to the transition point comprises determining the current value $I_v$ corresponding to the transition point in real time.

17. The method according to claim 6, wherein two successive measured value are temporally separated from one another by less than 5 ms.

18. The method according to claim 6, wherein two successive measured value are temporally separated from one another by less than 2 ms.

19. The method according to claim 7, wherein the measured values are recorded over at least 30% of the draw duration.

20. The method according to claim 7, wherein the measured values are recorded over at least 50% of the draw duration.

* * * * *